United States Patent [19]

Hirakawa et al.

[11] Patent Number: 4,776,578

[45] Date of Patent: Oct. 11, 1988

[54] APPARATUS FOR PREVENTING DISORDER IN SHEET ALIGNMENT

[75] Inventors: Tadashi Hirakawa; Yukuharu Seki; Toshihide Kato, all of Hiroshima, Japan

[73] Assignee: Mitsubishi Jukogyo Kabushiki Kaisha, Tokyo, Japan

[21] Appl. No.: 91,872

[22] Filed: Sep. 1, 1987

[51] Int. Cl.[4] ..... B65H 31/20

[52] U.S. Cl. ..... 271/223; 271/176; 271/227

[58] Field of Search ..... 271/176, 223, 227

[56] References Cited

U.S. PATENT DOCUMENTS 4,273,325 6/1981 Rodewald ..... 271/220
4,469,319 9/1984 Robb ..... 271/223 X

FOREIGN PATENT DOCUMENTS 51-21496 6/1976 Japan .
59-192069 12/1984 Japan .
203047 9/1986 Japan ..... 271/223

*Primary Examiner*—Richard A. Schacher
*Attorney, Agent, or Firm*—Bernard, Rothwell & Brown

[57] ABSTRACT

An apparatus for preventing sheets conveyed successively on a conveyor from being stacked up at the end of the conveyor in a disordered state in alignment is improved so as to assure stable operation without deforming edge portions of the handled sheets. The improvements reside in that the apparatus comprises a pair of guide members disposed on a sheet passageway above an inlet of a sheet stack-up section respectively so as to be swingable in the direction of traveling of the sheets and adjustable in positions in the lateral directions, a drive for independently adjusting the positions of the guide members in the lateral directions, sensors for detecting opposite side edge portions of a sheet moving on a transporting conveyor, and a control responsive to results of detection by the sensors for actuating the drive to adjust the positions of the respective guide members in the lateral directions.

1 Claim, 2 Drawing Sheets

APPARATUS FOR PREVENTING DISORDER IN SHEET ALIGNMENT

BACKGROUND OF THE INVENTION

1. Field of the Invention

The present invention relates to an apparatus for preventing disorder in sheet alignment in a sheet stack-up section for stacking up sheets transported successively by a transporting conveyor at its outlet portion.

2. Description of the Prior Art

Heretofore, as the above-described type of apparatus for preventing disorder in sheet alignment, an apparatus disclosed in Laid-Open Japanese Utility Model No. 59-192069 (1984) has been known. Explaining a general construction of this known apparatus, a brush having a large width wider than the maximum sheet width and densely planted with hair over its entire width is disposed along a sheet passageway above an inlet of a sheet stack-up section, and also at an outlet of a transporting conveyor is provided a press roll adapted to press the sheet on the transporting conveyor.

In this heretofore known apparatus for preventing disorder in sheet alignment, a sheet is forcibly ejected by pinching rotation of the transporting conveyor and the press roll, brush hair in a region corresponding to a sheet width is pushed out, while the brush hair remaining on the opposite sides of the sheet has a function of side guides upon transporting the sheet to the stack-up section, and thereby upon stacking up the sheets, it was intended that lateral slip of the sheet can be prevented by the remaining brush hair. However, if a rigidity of the brush hair is made too high, then the edges of the sheets would be deformed or cracked, also a resistive force against the sheet is increased, and hence the position of stacking would become unstable. On the contrary, if the rigidity of the brush hair is made too low, then the function of the brushes on the opposite side of the sheet of restraining a lateral slipping phenomenon of the sheet would be weakened. Thus, it was impossible to make a same brush have both the functions which are inconsistent with each other, and so, the known apparatus could not be said to be an apparatus of surely preventing disorder in sheet alignment.

SUMMARY OF THE INVENTION

It is therefore one object of the present invention to provide a novel apparatus for preventing disorder in sheet alignment, in which the above-described problems associated with the prior art apparatus are resolved, and which can operate reliably to prevent disorder in sheet alignment.

According to one feature of the present invention, there is provided an apparatus for preventing disorder in sheet alignment comprising a pair of guide members disposed on a sheet passageway above an inlet of a sheet stack-up section respectively so as to be swingable in the direction of traveling of the sheets and adjustable in positions in the lateral directions, drive means for independently adjusting the positions of the guide members in the lateral directions, sensor means for detecting opposite side edge positions of a sheet moving on a transporting conveyor, and control means responsive to results of detection by the sensor means for actuating the drive means to adjust the positions of the respective guide members in the lateral directions.

In operation, the guide members are preset in position according to a width of sheets to be handled, and thereby the both edges of the sheets are restrained in position. Then, while the sheets transported successively by a transporting conveyor would be displaced in position in the widthwise direction by various causes, this displacement is corrected by the operation that the sensor means detects the opposite side edge positions of the sheet being transported, in response to a detection signal from the sensor means the drive means is actuated to adjust the positions of the guide members, and thereby the side edge portions of the sheet can be surely guided. In the case where the above-mentioned displacement is too large, the sheet would strike against the guide member, but the guide member would swing forwards so that the advance of the sheet may not be hindered and also the sheet is made to fall quickly to prevent the sheet from being further disordered in alignment.

According to the present invention, the positions of the opposite side edges of the sheets being transported on a conveyor are detected, and upon falling of the sheets onto a stack of sheets the side edges of the successive sheets are restrained by guide members which are moved in position according to the results of detection. Therefore, the sheets can be stacked up regularly without disorder in alignment.

The above-mentioned and other objects, features and advantages of the present invention will become more apparent by reference to the following description of one preferred embodiment of the invention taken in conjunction with the accompanying drawings.

DESCRIPTION OF THE PREFERRED EMBODIMENT

Now the present invention will be described in greater detail in connection to the preferred embodiment illustrated in FIGS. 1 to 8.

Figure 8:
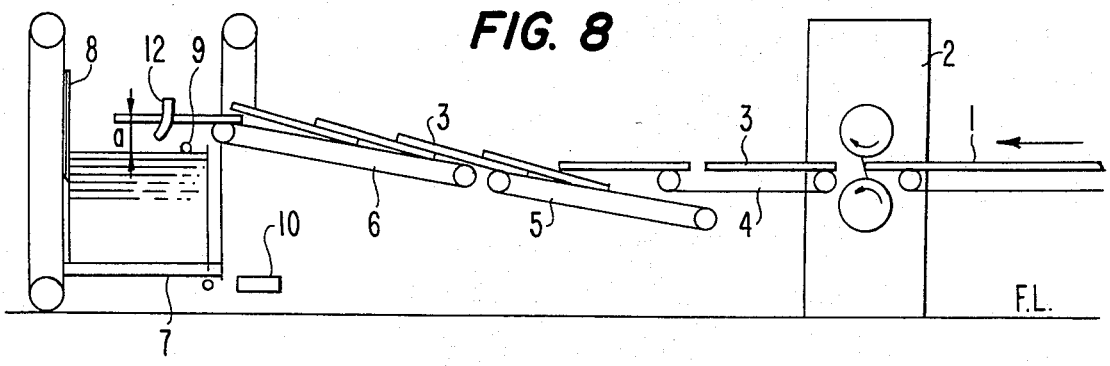
FIG. 8 is a front view showing a general construction of a sheet stack-up system embodying the apparatus according to the present invention.

A general construction of a sheet stack-up system in which the apparatus for preventing disorder in sheet alignment according to the present invention is embodied, is shown in FIG. 8. A corrugated cardboard web 1 produced continuously in the preceding step of the manufacturing process is cut along the direction of traveling into a number of narrower webs, thereafter each narrower web is cut along its widthwise direction into a predetermined length at a cut-off station 2, thus corrugated cardboard sheets 3 are formed, which are transferred from a cut-off outlet conveyor 4 to a singling conveyor 5 that is operated at a slower speed than the conveyor 4, and the corrugated cardboard sheets 3 are transported on a transporting conveyor 6 in an overlapped state like roof tiles and ejected one by one onto a sheet stack-up table 7. The ejected sheets 3 strike against a front butting wall 8, and then fall down to be stacked up on the sheet stack-up table 7. The top level of the sheets 3 stacked up on the table 7 is detected by a photo-electric tube 9, and vertical movement of the table 7 is controlled so that a level difference a between the top level and the level of the transporting conveyor 6 may be maintained nearly constant. Reference numeral 10 designates a limit switch adapted to be operated by lowering of the table 7 for stopping the drive for the table 7 and the like. When the sheets 3 have been stacked up and the table 7 has been lowered up to a predetermined extent, the limit switch 10 operates to stop lowering of the table 7 as well as traveling of the transporting conveyor 6, and thereby interrupts feeding of the sheets 3. Meanwhile, the stacked sheets 3 are ejected externally and transported to the next step of the process. Subsequently, the table 7 is raised again and set at a sheet throw-in and stack-up position, and then throwing-in for feeding of the sheets 3 in a standby state is recommenced by driving again the transporting conveyor 6. And, in order to stabilize the overlapping condition of the sheets to be thrown from the transporting conveyor 6 onto the sheet stack-up table 7, a well-known press roll 11 and means for detecting side edges of the sheets 3 are provided, and also a pair of side guide members 12 that can move in the widthwise directions of the sheet in accordance wit the detected side edge positions of the sheets 3 traveling on the transporting conveyor 6, are provided on the left and right sides as opposed to each other.

Figure 1:
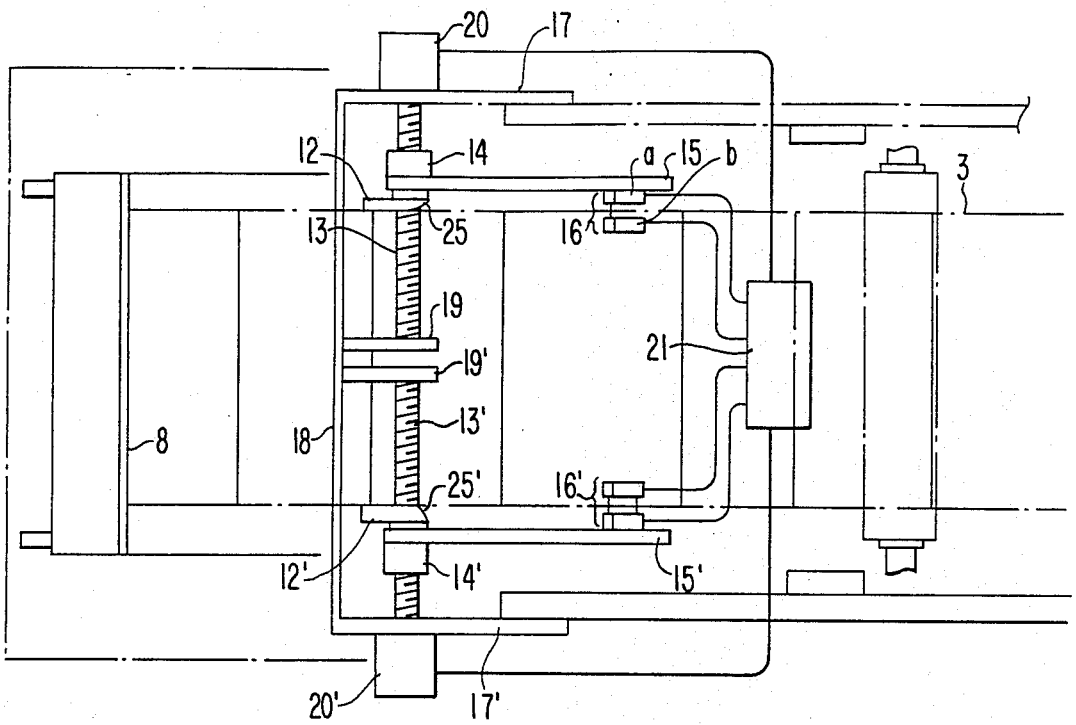
FIG. 1 is a plan view showing a general construction of one preferred embodiment of the present invention.
Figure 2:
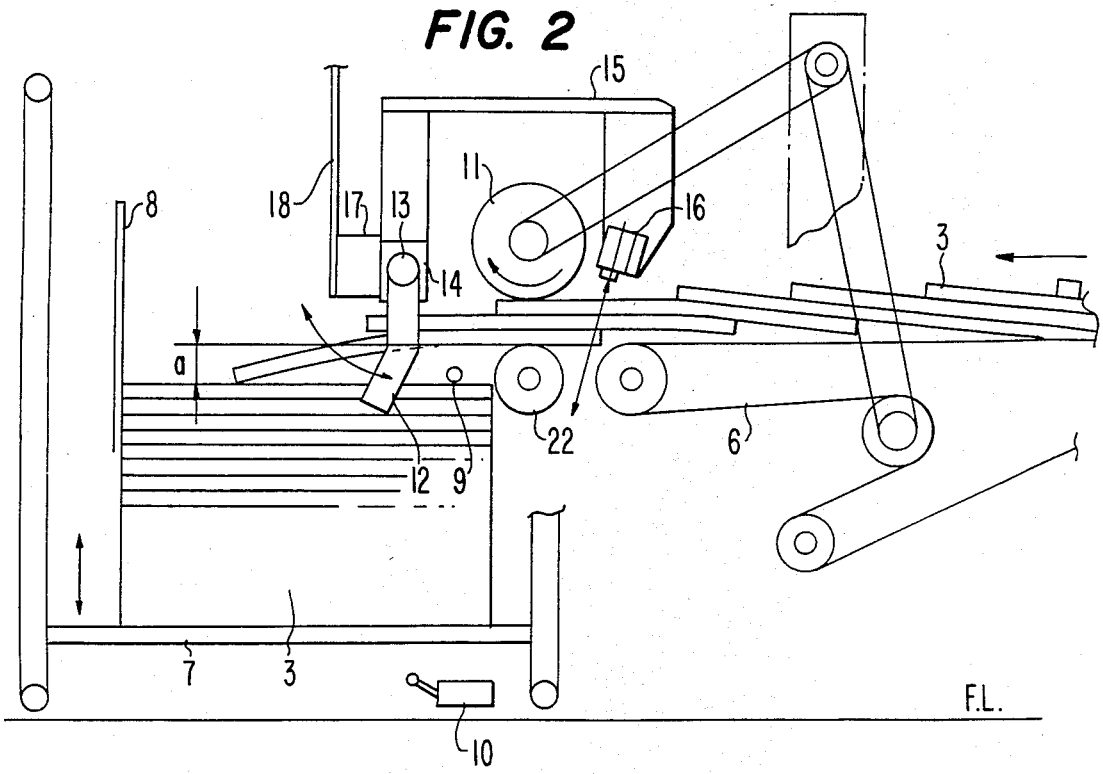
FIG. 2 is a front view of the apparatus shown in FIG. 1.
Figure 3:
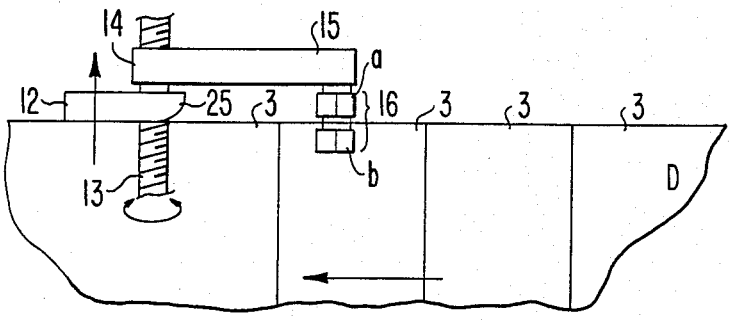
FIGS. 3 to 5, respectively, are enlarged partial plan view of the apparatus shown in FIG. 1.
Figure 4:
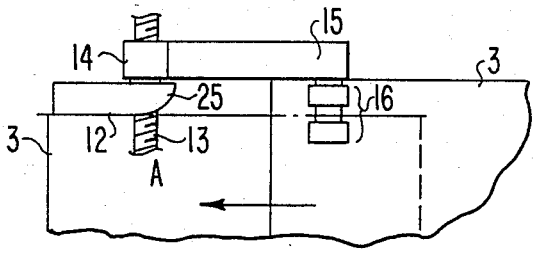

A structure and arrangement of the side guide members 12 are illustrated in FIGS. 1 and 2, and they will be explained with reference to these figures. The side guide members 12 and 12′ have their upper ends mounted to moving blocks 14 and 14′ so as to be swingable in the direction of traveling of the sheets 3. On sheet accepting surfaces of the guide members 12 and 12′ are provided guide surfaces 25 and 25′, respectively, for guiding the sheet inwardly. The moving blocks 14 and 14′ are threadedly engaged with moving screw shafts 13 and 13′ so that the moving blocks 14 and 14′ can be moved in the widthwise direction of the sheet 3 by rotating the moving screws 13 and 13′, respectively. On the other hand, on the moving blocks 14 and 14′ are mounted photo-electric tube groups 16 and 16′, respectively, for detecting sheet side edges via arms 15 and 15′, and so, the photo-electric tube groups 16 and 16′ can move integrally with the moving blocks 14 and 14′, respectively. One end of the moving screw shaft 13 is pivotably supported from a frame 17 and the other end is supported from a bracket 19 that is fixedly secured to a beam 18 laterally mounted between frames 17 and 17′ on the opposite sides, and the outside end of the moving screw shaft 13 is connected to a motor 20. Likewise, a moving screw shaft 13′ is pivotably supported by the frame 17′ and a bracket 19′ fixedly secured to the beam 18, and the outside end of the moving screw shaft 13′ is connected to a motor 20′. The frames 17 and 17′ are projected from a base frame of the transporting conveyor 6 or a manufacturing line, and they are fixedly mounted at predetermined positions. While the side guide members 12 and 12′ respectively operate independently of each other, but their constructions and operations are identical, and therefore, in the following description will be made with respect to only one of them. The photo-electric tube group 16 is composed of two photoelectric tubes a and b, and the position of the moving block 14 is controlled so that only one of the photoelectric tubes a and b is shielded from light. In more particular, control is effected in such manner that if the two photo-electric tubes are both shielded from light, then the block 14 is moved outwardly, while if neither of the two photo-electric tubes is shielded from light, then the block 14 is moved inwardly. In this way, in accordance with a light-shielded condition of the photo-electric tube group 16, a corresponding signal is sent to a controller 21 to operate the motor 20 connected to the moving screw shaft 13, so that the side guide member 12 can be moved depending upon a position of a sheet traveling on a transporting conveyor 6.

Figure 5:
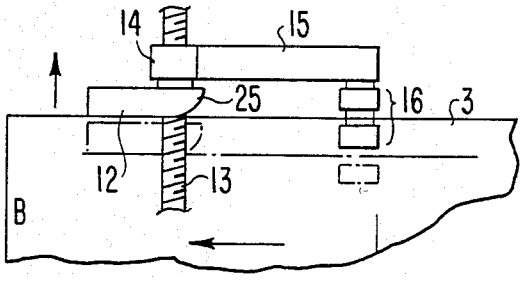
Figure 6:
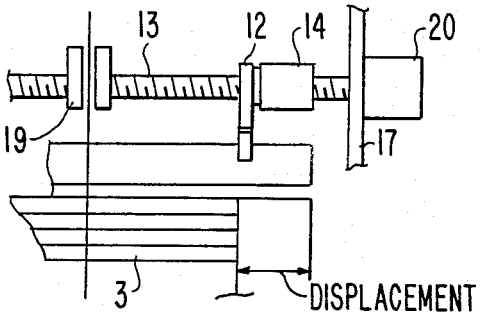
FIG. 6 is a partial side view showing a guide section in the apparatus shown in FIGS. 1 to 5.
Figure 7:
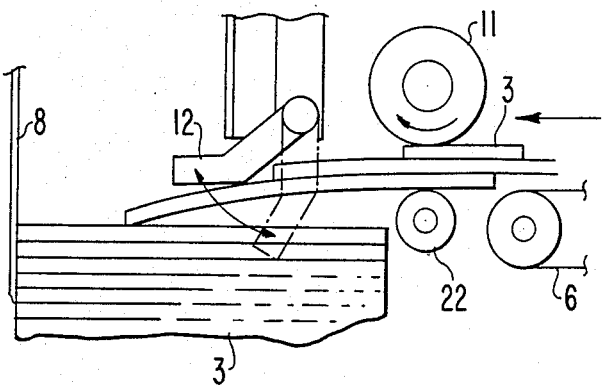
FIG. 7 is a partial front view showing the guide section in FIG. 6.

The press roll 11 is well-known one, and it is disposed in opposition to a throw-in section roller 22 provided in succession to the transporting conveyor 6 and rotates in the direction of an arrow. The sheet 3 is forcibly ejected onto a sheet stack-up table 7 as pinched between the press roll 11 and the throw-in section roller 22. It is to be noted that the press roll 11 is made to swing via a cylinder or the like not shown so that a pressing force acted upon the sheet can be controlled. The sheets 3 fed successively by the transporting conveyor 6 are not always ejected onto the sheet stack-up table 7 in a regularly aligned condition due to slipping caused by the cutting condition at the cut-off station 2, vibration in the midway of transportation or the like, and the tendency that the stack-up condition becomes unstable due to displacement in the widthwise direction or because of an air layer produced between the last sheet 3 and the top level sheet among the stacked sheets when the sheet is thrown onto the table 7, is strong. In the illustrated embodiment, a sheet laterally displaced a little during transportation is corrected in alignment by guide surface 25 of the side guide member 12. Or else, in the case where the sheet is laterally displaced to such extent that two photo-electric tubes in the photo-electric tube group 16 are simultaneously shielded from light or simultaneously not shielded from light (the state shown in FIG. 4), the motor 20 is driven to move the guide member 12 as shown in FIG. 5, thereby resistance upon throwing in the sheet is reduced to assure smooth stacking up, and also the sheets thrown in are surely restrained in lateral alignment by the side guide member 12. Furthermore, in the case of a sheet 3 having an especially so large displacement that the displacement cannot be compensated by movement of the guide member 12, then as shown in FIGS. 6 and 7, the sheet 3 causes the guide 12 to swing and escape in the direction of traveling of the sheet 3, and thereby jamming up of the sheets 3 can be avoided. At the same time, the sheet 3 is made to fall down quickly by the guide member 12, and thereby the sheet 3 is prevented from being further disordered in alignment. The illustrated embodiment of the present invention makes it possible to stack up sheets more reliably without making the successive sheets jam up. It is to be noted that by presetting the positions of the moving blocks 14 and 14′ on the moving screw shafts 13 and 13′ so as to have an interval corresponding to the width of the sheets 3, the positions of the moving blocks 14 and 14′ are not limited by a sheet traveling position and a sheet width on the transporting conveyor 6.

It is to be noted that the present invention should not be limited only to the above-described embodiment, but various changes and modifications can be made to the illustrated construction without departing from the scope of the invention.

What is claimed is:

1. An apparatus for preventing disorder in sheet alignment, having a pair of guide members disposed on a sheet passageway above an inlet of a sheet stack-up section respectively so as to be swingable in the direction of traveling of the sheets and adjustable in positions in the lateral directions, drive means for independently adjusting the positions of said guide members in the lateral directions, sensor means for detecting opposite side edge positions of a sheet moving on a transporting conveyor, and control means responsive to results of detection by said sensor means for actuating said drive means to adjust the positions of said respective guide members in the lateral directions.

* * * * *